United States Patent [19]

Nagashima

[11] Patent Number: 4,632,282

[45] Date of Patent: Dec. 30, 1986

[54] SPOUT ASSEMBLY

[76] Inventor: Hirohisa Nagashima, 718 Ohnohara, Shimo-akasaka, Kawagoe-shi, Saitama-ken, Japan

[21] Appl. No.: 585,798

[22] Filed: Mar. 2, 1984

[51] Int. Cl.[4] ..... B65D 5/06

[52] U.S. Cl. ..... 222/529; 222/530; 222/551; 222/85 SP

[58] Field of Search ..... 222/529, 527, 530, 526, 222/528, 531, 537, 541, 525, 551, 570, 572, 573, 567, 566, 143; 220/85 SP, 288, 306, 319

[56] References Cited

U.S. PATENT DOCUMENTS

| | | | |
|---|---|---|---|
| 2,565,699 | 8/1951 | Rieke | 222/529 |
| 2,661,128 | 12/1953 | Rieke | 222/529 |
| 3,502,246 | 3/1970 | Kelbch | 222/529 |
| 3,613,966 | 10/1971 | Summers | 222/529 |
| 3,831,817 | 8/1974 | Leccese | 222/143 |
| 4,111,331 | 9/1978 | Summers | 220/288 |
| 4,135,639 | 1/1979 | Dillon et al. | 220/288 |
| 4,236,629 | 12/1980 | Dwinell | 222/529 |
| 4,295,583 | 10/1981 | Schurr | 222/566 |
| 4,320,861 | 3/1982 | Rieke et al. | 222/541 |
| 4,422,563 | 12/1983 | Babiol | 222/529 |

FOREIGN PATENT DOCUMENTS

| | | | |
|---|---|---|---|
| 0018930 | 11/1980 | European Pat. Off. | 222/530 |

*Primary Examiner*—Joseph J. Rolla
*Assistant Examiner*—Michael S. Huppert
*Attorney, Agent, or Firm*—Jordan & Hamburg

[57] ABSTRACT

A spout assembly of the invention substantially comprises a spout body fastenable to a container, a crimping ring for securing the spout body to the container, a cap to be mountable and dismountable with respect to the spout body, a pair of handles mounted on the cap and sealing member for sealing between the spout body and the cap. The spout assembly is particularly designed so that outer diameter of the cap is smaller than a maximum inner diameter of the spout body and that the sealing means is formed by an under surface of a disc-like top wall portion of the cap and a sealing flange portion of the spout body.

6 Claims, 32 Drawing Figures

Fig. 19
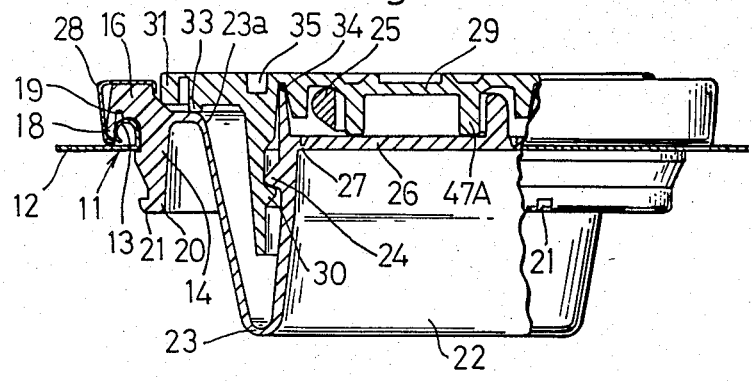
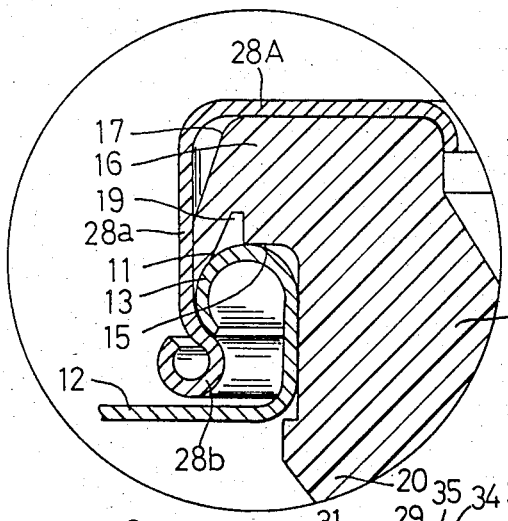
Fig. 20
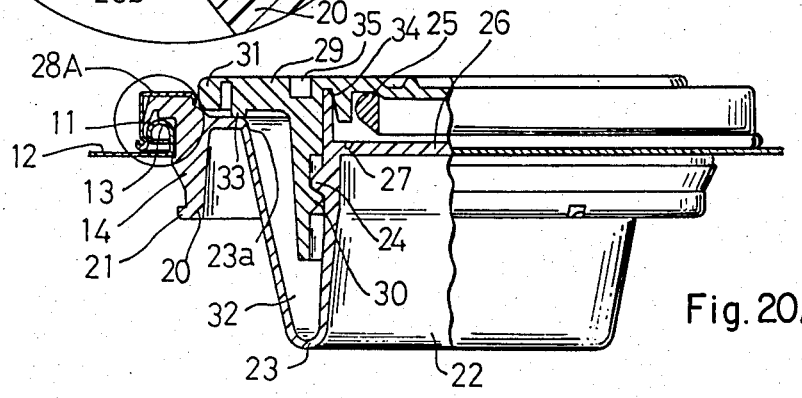
Fig. 20A
Fig. 21
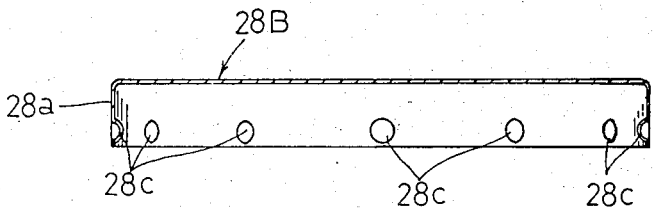

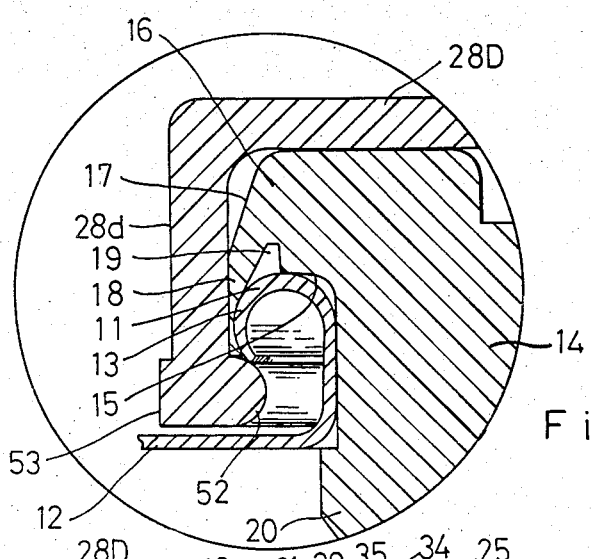
Fig. 25
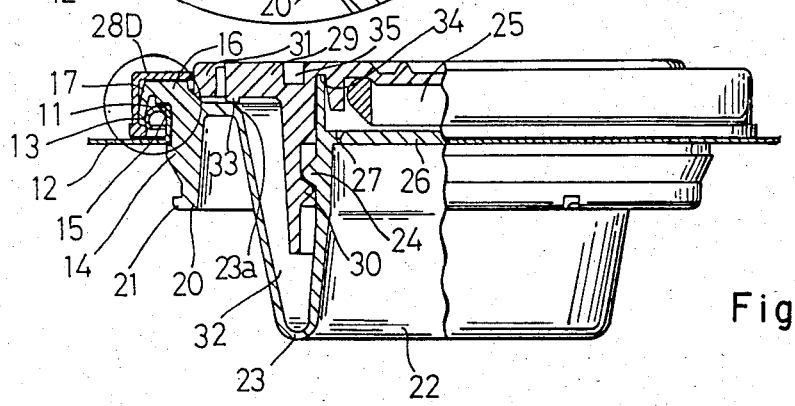
Fig. 25A
Fig. 26
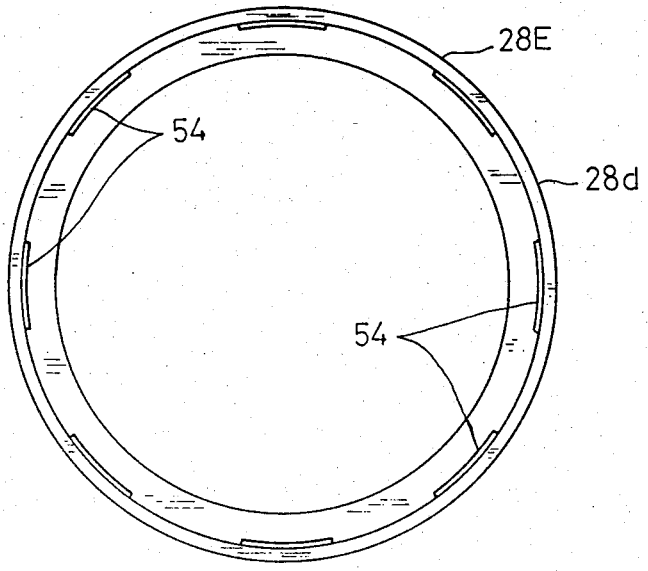

SPOUT ASSEMBLY

BACKGROUND OF THE INVENTION

The invention relates to a spout assembly having a pouring spout which can be fitted to an opening of a container such as a can, a plastic container or the like for containing liquid.

The spout assembly 9 heretofore in use comprises the following as shown in FIG. 1 (U.S. Pat. No. 4,236,629):

(1) a spout base 3 made of a soft plastic material, which is fixed by means of calking, such as an annular metal crimping ring 2 to a container opening 1.

(2) a spout 4 constructed integrally with the spout base 3, which is bent so that the cross section of the spout 4 becomes an approximately U-shape, the spout 4 being contracted to be stowed away in the container in case of closing and also the spout being pulled out from the container opening 1 to be formed of a pouring spout in case of opening, and (3) a cap 8 having an internal thread formation 6 which is fitted with an external thread formation 5 provided on the periphery of the upper end of the spout 4, the cap 8 being made of a plastic material so that a handle 7 overlaying the metal crimping ring 3 is integrally formed therewith.

SUMMARY OF THE INVENTION

A primary object of the invention is to provide a spout assembly which can be fitted to a container opening by calking, such as using an annular crimping ring so that a cap is fastened to the spout, whereby packing and delivering are easy.

A further object of the invention is to provide the spout assembly which permits a spout opening to be sealed by a cap even after removing of a sealing diaphragm.

Other and incidental objects of the invention will become apparent from the following specification and the drawings.

DESCRIPTION OF THE DRAWINGS

The invention will now be described with reference to the accompanying drawings wherein:

FIG. 6, FIG. 7, FIG. 8, FIG. 9, FIG. 10, FIG. 11, FIGS. 12 and 13, FIG. 14, FIG. 15, FIG. 16, FIG. 17, FIG. 18, FIG. 19, FIG. 20, FIG. 21, FIGS. 22 and 23, FIG. 24, FIG. 25, FIG. 26 FIGS. 27 and 28, FIGS. 29 and 30, FIG. 31 and FIG. 32 are respectively explanatory drawing(s) showing different embodiments.

DESCRIPTION OF THE PREFERRED EMBODIMENTS

Figure 1:
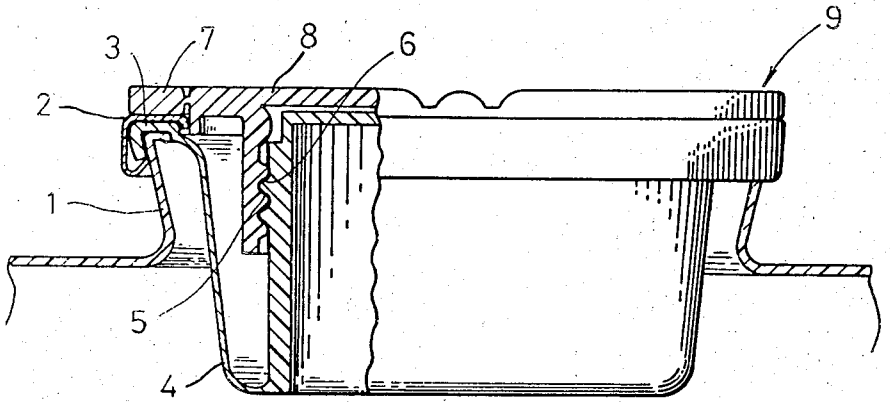
Fig. 1 Prior Art
FIG. 1 is a view in elevation, partly in section showing an embodiment heretofore in use.

In the embodiments shown in FIGS. 2 to 5, reference numeral 11 is a spout assembly fitting portion formed at a top plate 12 of a container such as a can or the like, which is made to form an annular prominence 13 by bending a tip of an opening upwardly and outwardly.

Reference numeral 14 is a spout base made of a soft plastic material in the shape of comparatively thick wall which is fitted to the spout assembly fitting portion 11.

A slot 15 is formed around the outer periphery of the spout base 14. The annular prominence 13 of the spout assembly fitting portion 11 is inserted in and fitted to the slot 15.

An outer wall 17 of the ring fitting portion 16 in the upper part of the spout base 14 is formed with a taper shape so that a lower end of the outer wall 17 is enlarged.

At the outer and upper wall corner of the slot 15, a concave groove 19 is provided to make it easy to keep flexibility of an outer overhang 18.

At the outer periphery of an inserting portion 20 provided at the lower end of the spout base 14, a plurality of projecting pieces 21 are made to prevent the spout assembly 36 from being detached from the spout assembly fitting portion 11 at the top plate 12 of the container when the spout assembly 36 is installed.

Reference numeral 22 is a spout which is integrally connected to the spout base 14 and bent so that the cross section thereof becomes similar to a U-shape. The spout is contracted to be stowed away when closed and is pulled out to form a pouring spout when opened.

The spout 22 is provided with a thin wall portion 23 which forms a bend portion in case of closing of the spout 22.

A male screw portion 24 is provided at the periphery of the upper end of the spout 22.

At an upper end of the spout 22, a sealing diaphragm 26 for sealing the opening portion is integrally connected with the spout 22 through a thin wall portion 27. The sealing diaphragm 26 has a ring 25 to be pulled by a finger. Reference numeral 28 is an annular metal ring, with which the spout base 14 is fixed to the spout assembly fitting portion 11 of the top plate 12 of the container by fitting and calking to the ring fitting portion 16 of the spout base 14.

Reference numeral 29 is a cap made of a comparatively rigid plastic material. The cap 29 has a female screw portion 30 which is screwed to the male screw portion 24 of the spout 22.

The cap 29 is further provided with handles 31 integrally joined to a peripheral edge of a top wall. The handles 31 are made so that the outside diameter of each of the handles 31 is slightly smaller than the inside diameter of the annular metal ring 28.

A blocking and sealing rim 33 is provided at an inner surface of an outer edge portion of the cap 29 to prevent water, dust, and so on from entering into the convavity 32 of the spout 22 by contacting with the inner flange portion of the spout 22 when closed.

At the inside of a portion of the cap 29 corresponding to the upper end of the spout 22, a concave groove 34 is formed to keep airtight by receiving of the upper end of the spout 22.

On the surface of the cap 29, slits 35, 35 are provided to be interlocked with claws of an automatic capper (not shown) for fixing the cap 29 to the spout base 14.

A flange base portion 23*a* of the spout 22 is made to be thin in wall thickness to make it easy to change the shape thereof.

According to the above-mentioned structure, a female screw portion 30 of the cap 29 is engaged with a male screw portion 24 of the spout 22 by screwing; and thence the annular metal ring 28 is fitted to the ring fitting portion 16 of the spout base 14 after fitting of the slot 15 of the spout base 14 to a spout assembly fitting portion 11 at the top plate 12 of the container at the above condition. Thereafter, the spout base 14 can be fixed to the spout assembly fitting portion 11 of the top plate 12 by calking with a calking machine.

Figure 2:
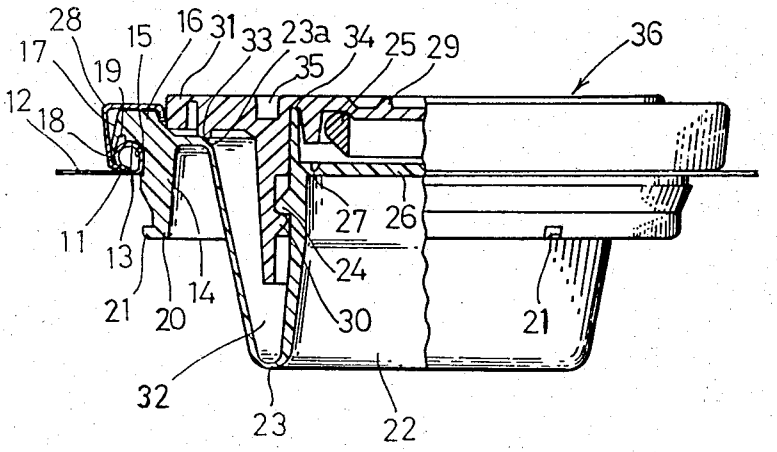
FIG. 2 is a view in elevation, partly in section showing an embodiment of the invention.

The spout assembly 36 is fitted to the spout assembly fitting portion 11 formed at the top plate 12 of the container as shown in FIG. 2, in case of closing.

Figure 3:
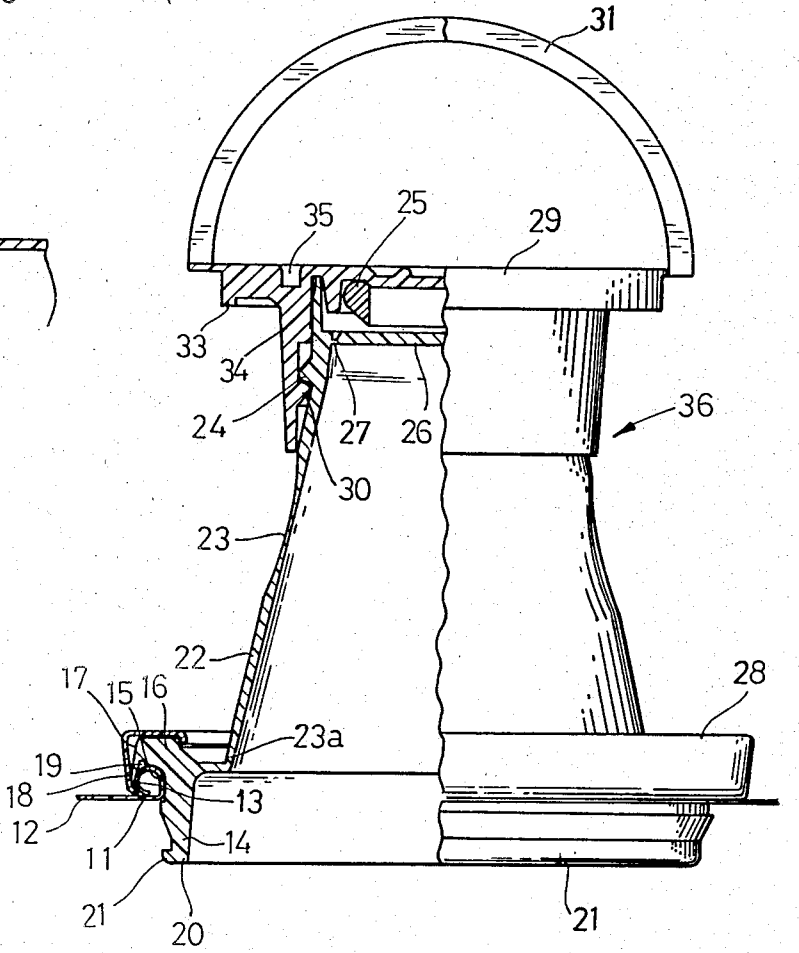
FIG. 3 is a view in elevation, partly in section showing an embodiment of the invention in FIG. 2, wherein the spout is pulled out.
Figure 4:
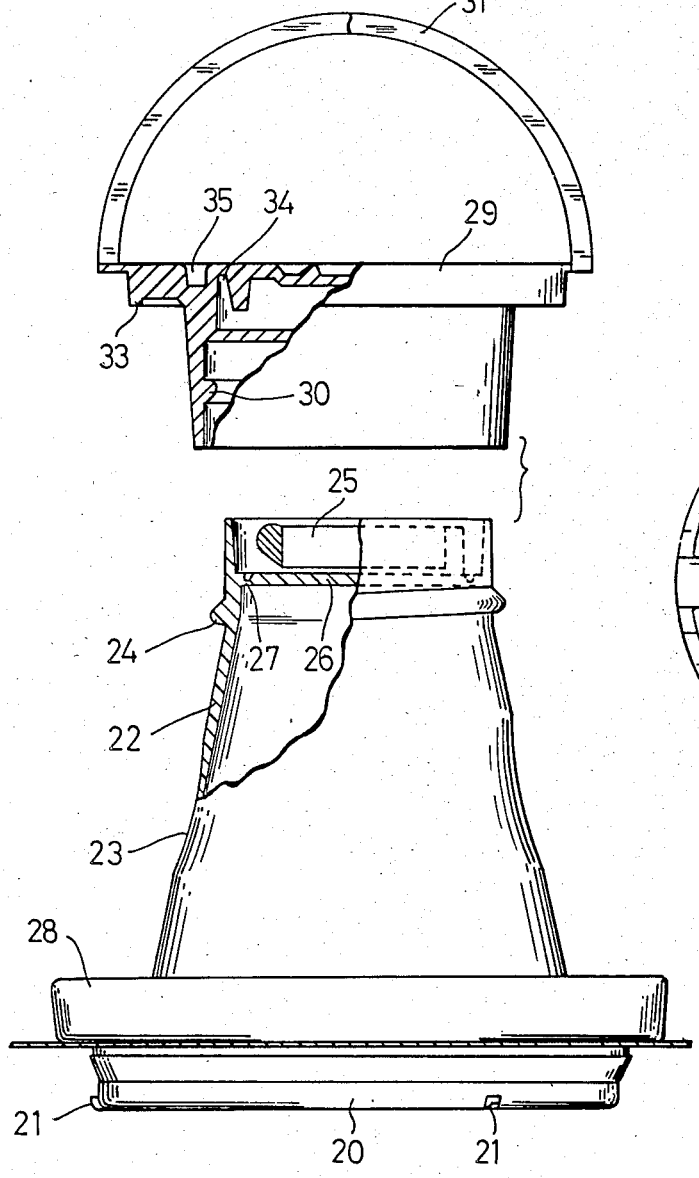
FIG. 4 is a view in elevation, partly in section showing an embodiment of the invention in FIG. 3, wherein a cap is removed.
Figure 5:
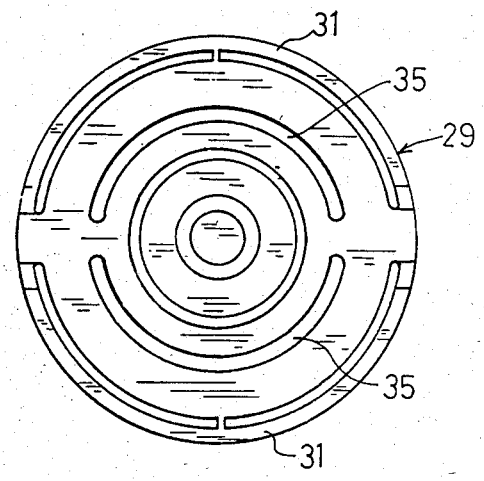
FIG. 5 is a plan view of the cap used in the embodiment in FIG. 2.

In case of opening, the spout 22 constitutes a pouring spout, which is formed by bending the handles 31 of the cap 29 inwardly from both sides thereof and pulling up as shown in FIG. 3. Then the cap 29 is unscrewed and removed from the spout 22 as shown in FIG. 4. The sealing diaphragm 26 is cut away at the thin wall portion 27 by pulling the ring 25 by finger, so that the opening portion can be formed.

After the use of the spout assembly 36, the cap 29 is screwed onto the upper end of the spout 22, whereby the concave groove 34 fits on the top of the spout 22, and therefore it makes possible to keep air-tight, and to prevent the liquid from leaking from the container. As shown in FIG. 2, the spout assembly 36 can be made small by pushing down the cap 29.

Various other emboidments of the spout assemblies according to the invention will be explained by referring to FIGS. 6 to 33. In the explanations of these embodiments, the same component parts as the aforesaid embodiments of the invention will be affixed with the same reference numerals in order to simplify the description.

Figure 6:
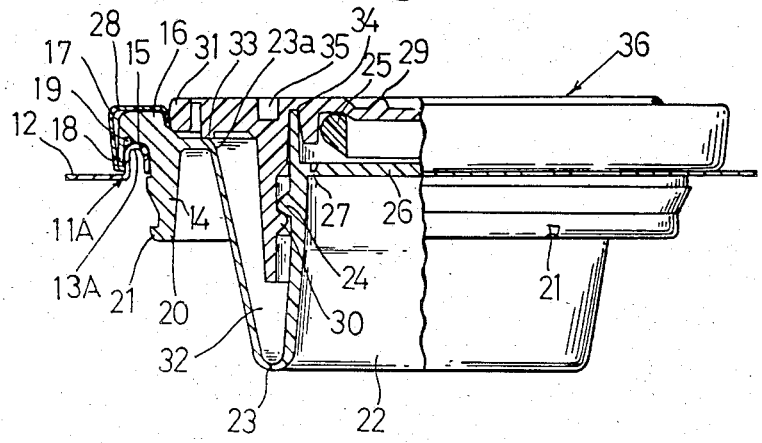

In the embodiment shown in FIG. 6, what differs from the aforesaid embodiment of the invention shown in FIGS. 2 to 5 is that the spout assembly 36 is fitted to a spout assembly fitting portion 11A made at the top plate 12 by bending an edge of an opening upwardly and inwardly to form a prominence 13A of the inverted U-shape in cross section. In this manner it is also possible to fit the spout assembly 36 to the spout assembly fitting portion 11A at the top plate 12 of the container.

Figure 7:
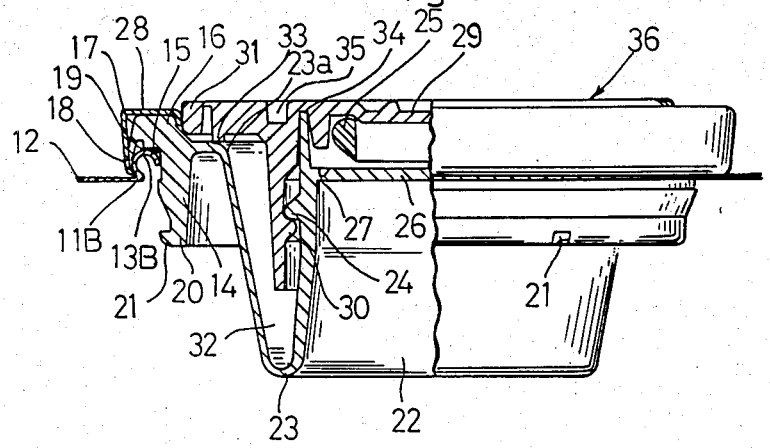

In the embodiment shown in FIG. 7, what differs from the aforesaid embodiment of the invention shown in FIGS. 2 to 5 is that the spout base 14 is fitted to the spout assembly fitting portion 11B formed at a top plate 12 by bending an edge of an opening upwardly and inwardly to form a prominence 13B of the ringed shape in cross section. In this manner, it is also possible to fit the spout assembly 36 to the top plate 12 of the container.

Figure 8:
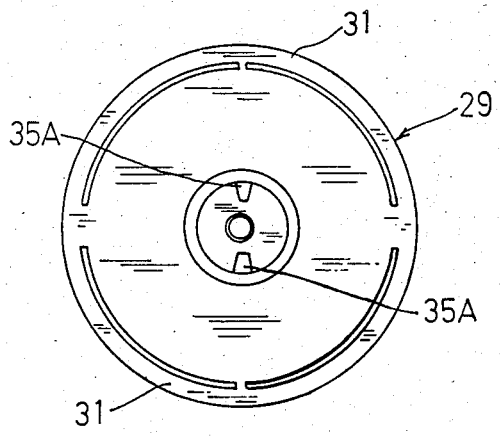

In the embodiment shown in FIG. 8, what differs from the aforesaid embodiments of the invention shown in FIGS. 2 to 5 is that slits 35A, 35A which can be interlocked with claws of an automatic capper are provided at about a central position on the surface of the cap 29. Even in such a structure, the cap 29 can be fixed to the screw portion 24 of the spout 22.

Figure 9:
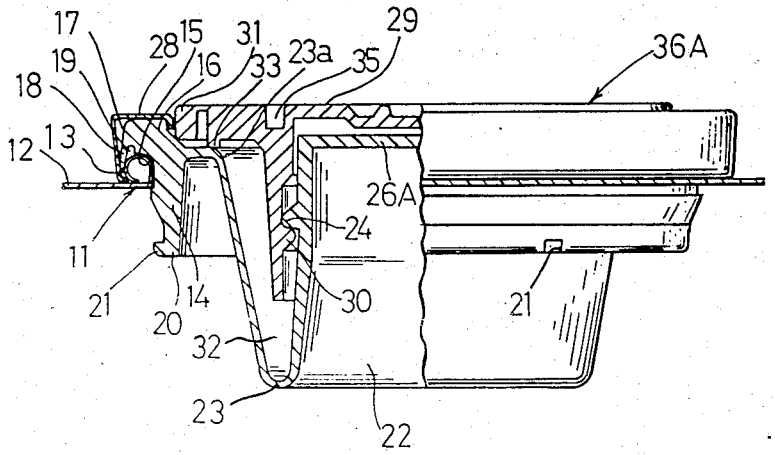

In the embodiment shown in FIG. 9, what differs from the aforesaid embodiments of the invention shown in FIGS. 2 to 5 is that a sealing diaphragm 26A is integrally provided at a top end of the spout 22. The spout can be opened by cutting the sealing diaphragm 26A. Even in such a structure, the spout assembly 36A can be fitted to the spout assembly fitting portion 11 of the top plate 12.

Figure 10:
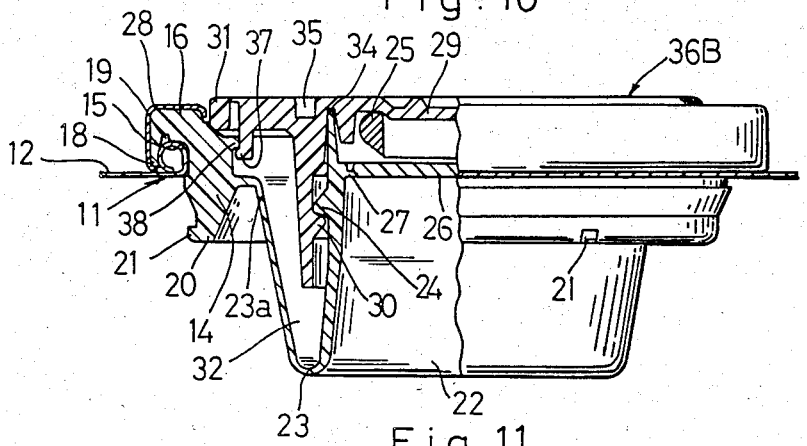

In the embodiment shown in FIG. 10, what differs from the aforesaid embodiments of the invention shown in FIGS. 2 to 5 is that a pair of a female screw portion 37 and male screw portion 38 which has a same screw pitch as the screw pitch of the male screw portion 24 of the spout 22 and the female screw portion 30 of the cap 29 respectively is made so as to make the inside wall of the spout base 14 be fitted to the outside wall of a cap 29 in case of closing of the spout assembly 36B. When the spout 22 is retracted, the thread screw 37 of the cap 29 is threadably engaged with the thread screw 38 of the spout base 14, and thereby thrusting out of the cap 29 due to the internal pressure of the container is surely prevented.

Figure 11:
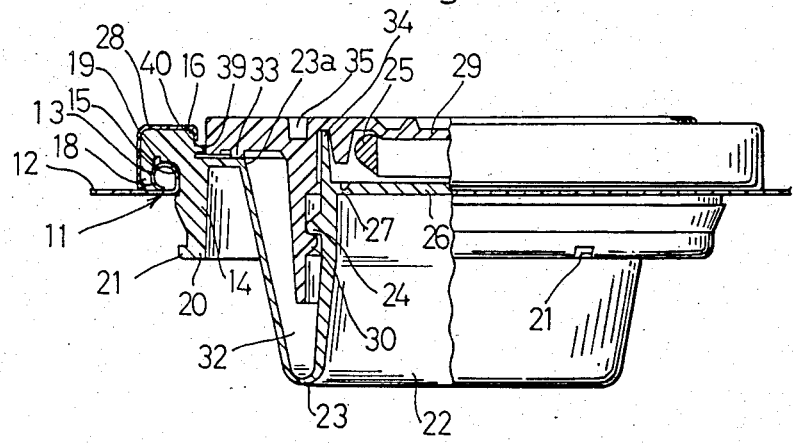
Figure 12:
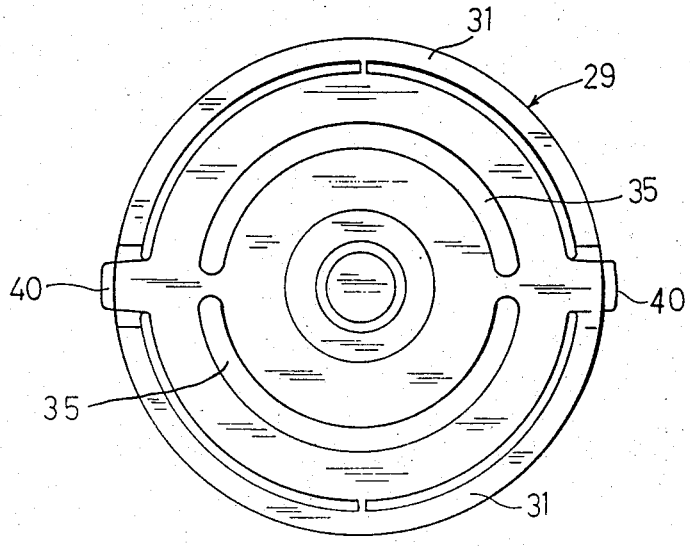

In the embodiments shown in FIGS. 11 and 12, what differs from the aforesaid embodiment of the invention shown in FIG. 10 is that a flange portion 39 for preventing the cap from falling off is provided at the inside wall surface of the spout base 14, and portions 40, 40 which correspond to the flange portion 39 are made at the top edge of the joint portions of the handles 31 of the cap 29. Even in such a structure, it is possible to prevent surely the cap 29 from thrusting out due to the internal pressure of the container.

Figure 13:
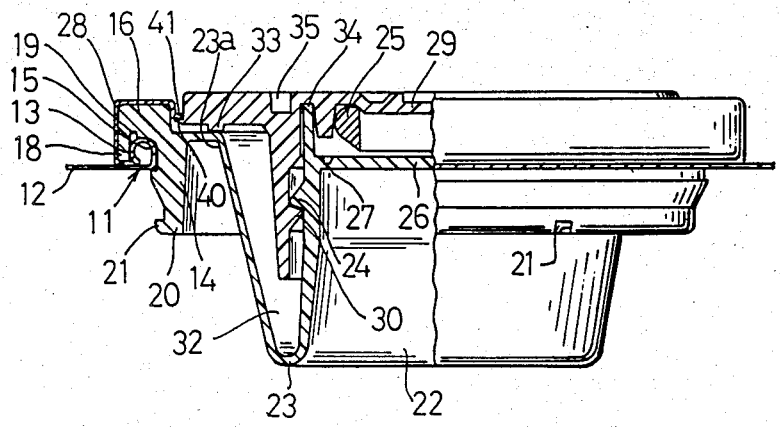

In the embodiments shown in FIG. 13, what differs from the aforesaid emboidment of the invention shown in FIGS. 11 and 12 is that a flange portion 41 for preventing the cap 29 from falling off is provided at the inside portion of the annular metal ring 28. Even in such a structure, it is possible to obtain the same working effect as the working effect of the embodiment shown in FIGS. 11 and 12.

Figure 14:
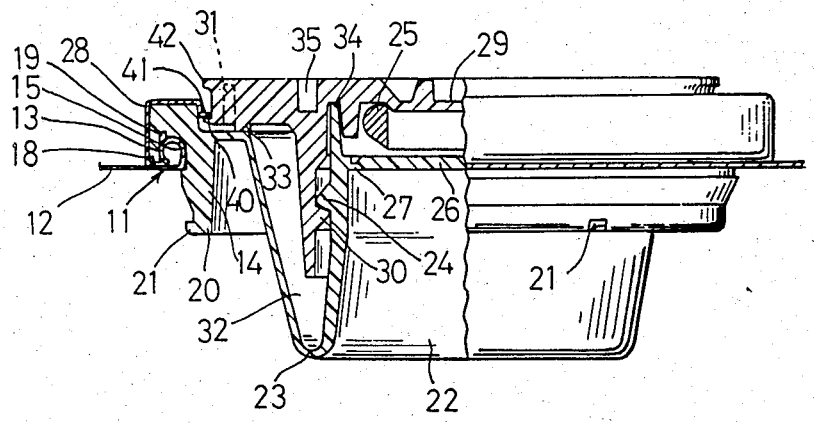

In the embodiment shown in FIG. 14, what differs from the aforesaid embodiments of the invention shown in FIGS. 2 to 5 is that the top surface of the cap 29 is made higher than the top surface of the annular metal ring 28, and a projecting part 42 is made at the periphery of the upper ends of the handles 31. Owing to such a structure, it is possible to grasp the handles 31 easily and bend it upwardly.

Figure 15:
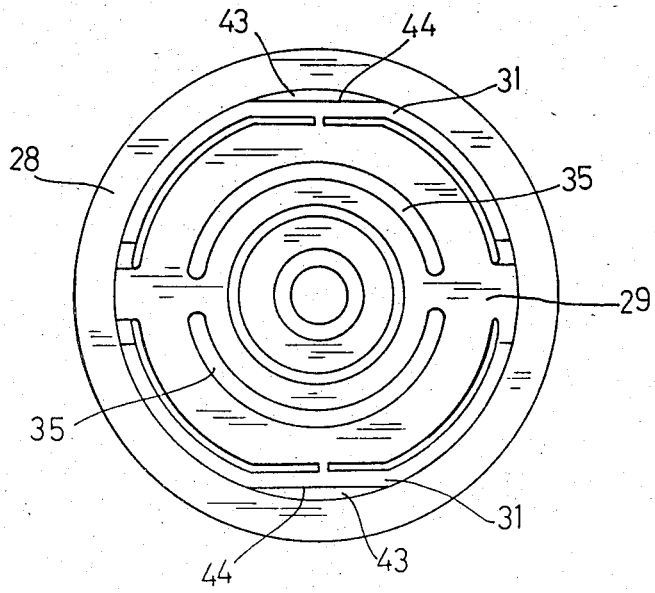

In the embodiment shown in FIG. 15, what differs from the aforesaid embodiment of the invention shown in FIGS. 2 to 5 is that each of the handles 31 is provided with a portion 44 formed at the periphery of a top portion of the handles 31 to make gaps 43, 43 which can be inserted by a finger or the like between a periphery portion of the upper end of the handles 31 and the inside portion of the annular metal ring 28. Even in such structure, it is possible to pull out the handles 31 easily.

Figure 16:
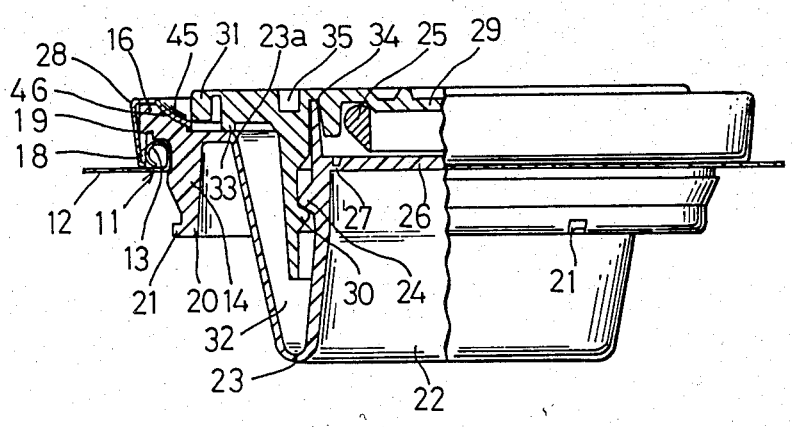

In the embodiment shown in FIG. 16, what differs from the aforesaid embodiment of the invention shown in FIGS. 2 to 5 is that a plurality of concaves 45 are provided at a spout base 14 along a circumferential direction. A plurality of concaves 46 are also provided at a crimping ring 28 so that the concaves 46 are fitted into the concaves 45. By the aid of the concaves 45 and 46, it is easy to pull out the handles by finger.

Figure 17:
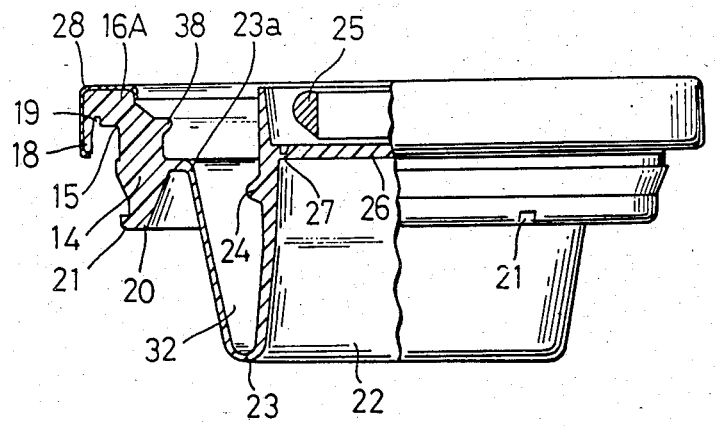

In the embodiment shown in FIG. 17, what differs from the aforesaid embodiment of the invention shown in FIGS. 2 to 5 is that a spout base 14 is provided with a ring fitting portion 16A for previously fitting a crimping ring 28 to the spout base 14.

Figure 18:
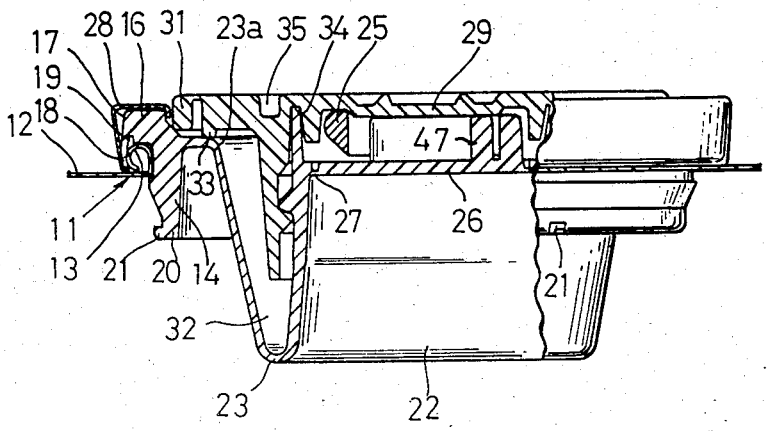

In the embodiment shown in FIG. 18, what differs from the aforesaid embodiments of the invention shown in FIGS. 2 to 5 is that a piece 47 which contacts with the inside wall surface of the cap 29 directly and prevents the sealing diaphragm 26 from the breakage is formed integrally with sealing diaphragm 26. According to such a structure, it is possible to prevent effectively from the breakage of the thin wall portion 27 by the piece contacting directly with the inside wall surface of the cap 29 to prevent the cap 29 from the movement even in case of the pressure acting upon the sealing diaphragm 26 caused by the internal pressure of the container.

In the embodiment shown in FIG. 19, what differs from the aforesaid embodiment of the invention shown in FIG. 18 is that a piece 47A which contacts with the sealing diaphragm 26 directly is integrally provided at the inside wall surface of the cap 29. Even in such a structure, it is possible to obtain the same working effect as that of the embodiment shown in FIG. 18.

In the embodiment shown in FIG. 20, what differs from the aforesaid embodiment of the invention shown in FIGS. 2 to 5 is that an annular metal ring 28A is made to securely fit the spout base 14 to the spout fitting portion 11 of a top plate 12 of the container by making the annular metal ring 28A fit on the ring fitting portion 16 of the spout base 14 after the slot 15 of the spout base 14 is fitted to the spout assembly fitting portion 11 of the top plate 12. At the lower end of the periphery wall **28*a* of the annular metal ring 28A, an annular curled portion 28*b* is formed to fit to the spout assembly fitting portion 11 of the top plate 12**.

Figure 22:
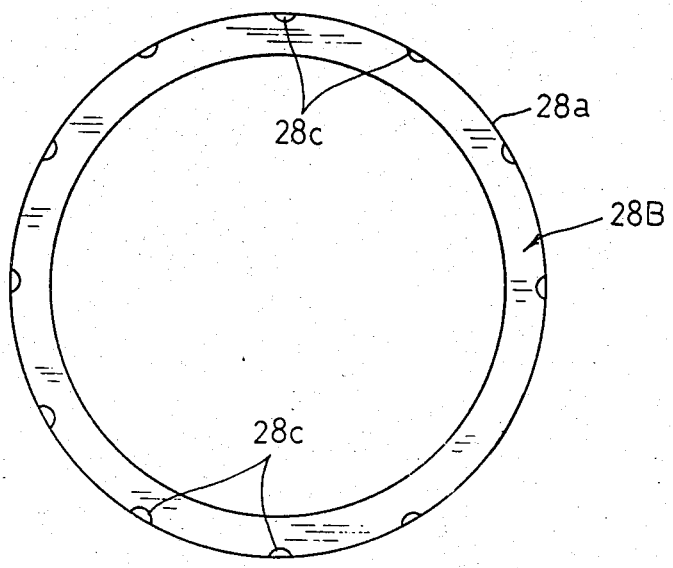

FIGS. 21 and 22 show a modification of the crimping ring metal 28A shown in FIG. 20. As is shown in FIGS. 21 and 22, an annular metal crimping ring 28B is provided with a plurality of projecting pieces 28C inwardly projecting and arranged on a lower end of the periphery wall **28*a*. Even in such a structure of the annular metal ring 28B, it is possible to obtain the same working effect as the effect of the annular metal ring 28A**.

Figure 23:
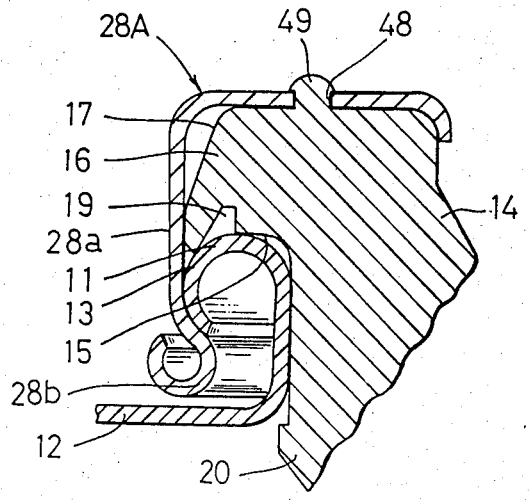

In the embodiment shown in FIG. 23, what differs from the aforesaid embodiment of the invention shown in FIG. 20 is that a plurality of holes 48 are provided on the top surface of the annular metal ring 28A and a plurality of corresponding projections 49 which correspond to the holes 48 are provided on the top surface of the spout base 14 integrally with the spout base 14. Owing to such a structure, it is possible to securely fit the annular metal ring 28A to the spout base 14.

Figure 24:
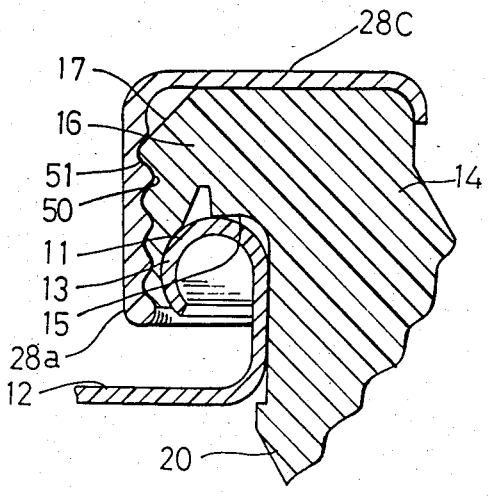

In the embodiment shown in FIG. 24, what differs from the aforesaid embodiment of the invention shown in FIG. 20 is that a female screw portion 50 is provided at an inner surface of the periphery wall of the annular metal ring 28C and a male screw portion 51 is provided at the outer periphery portion of the ring fitting portion 16 of the spout base 14. Owing to such a structure, a male screw portion 51 can be meshed with the female screw portion, and it is, therefore, possible to fix the spout base 14 to the spout assembly fitting portion 11 of a top plate 12 by screwing the annular metal ring 28C.

In the embodiment shown in FIG. 25, what differs from the aforesaid embodiment of the invention shown in FIG. 20 is that an annular plastic ring 28D which is made of a plastic material is substituted for the annular metal ring 28A. Even in such a structure, it is possible to obtain the same working effect as the effect of the embodiment shown in FIG. 20. Further, reference numerals 52 and 53 are projecting pieces which are integrally provided at the lower end of a periphery wall **28*d* of the annular plastic ring 28D and project respectively inwardly and outwardly. The projecting piece 53 which projects outwardly is used as a handhold in case of putting the annular plastic ring 28D on the spout base 14**.

Figure 27:
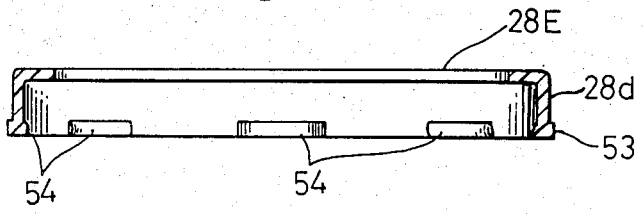

An annular plastic ring 28E shown in FIGS. 26 and 27 differs from the annular plastic ring 28D shown in FIG. 25 in that a plurality of cylindrical projections 54 are arranged on the inside walls of the lower end portions of the periphery walls **28*d*. Even in such a structure of the annular plastic ring 28E, it is possible to obtain the same working effect as the effect of the annular plastic ring 28D**.

Figure 28:
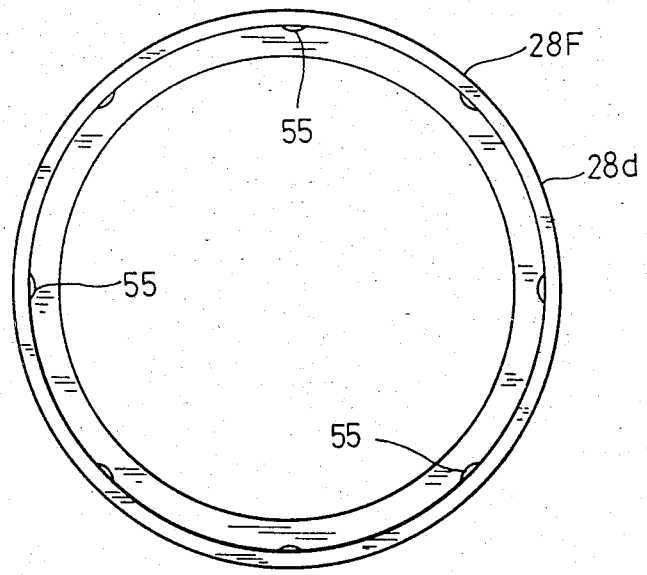
Figure 29:
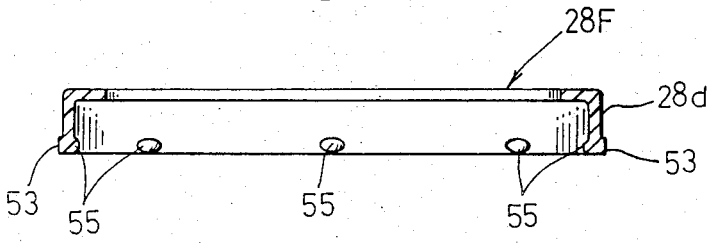

The embodiments of annular plastic rings 28F shown in FIGS. 28 and 29 differ from the annular plastic ring 28D shown in FIG. 25 in that a plurality of hemispherical projecting pieces 55 are provided at inner walls of the lower end portions of the periphery walls **28*d* of the annular plastic rings 28F. Even in such a structure of the annular plastic rings 28F, it is possible to obtain the same working effect as the effect of the annular plastic ring 28D**.

Figure 30:
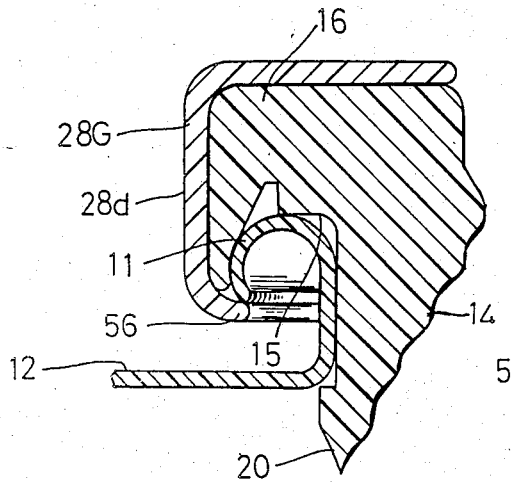

In an annular plastic ring 28G shown in FIG. 30, what differs from the aforesaid embodiment of the invention shown in FIG. 25 is that an engaging portion 56 is constructed by bending a lower end portion of the periphery wall **28*d* inwardly. Even in such a structure, it is possible to obtain the same working effect as the effect of the embodiment shown in FIG. 25** aforesaid.

Figure 31:
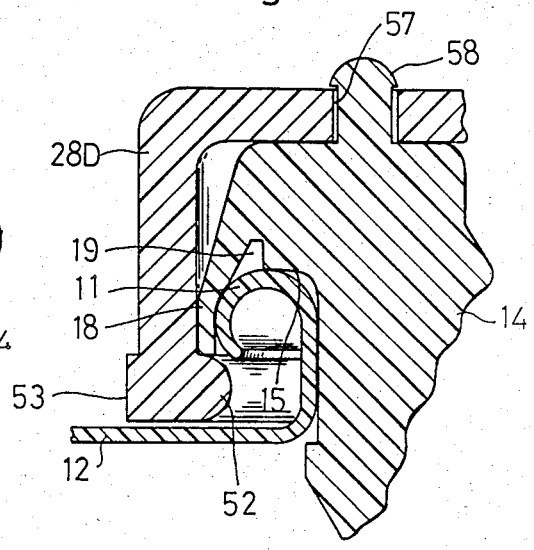

In the embodiment shown in FIG. 31, what differs from the aforesaid embodiment of the invention shown in FIG. 25 is that a plurality of holes 57 are provided at the top surface of an annular plastic ring 28D and a plurality of pieces are arranged on a top surface of the spout base 14. Each of the pieces 58 is fitted into each of the corresponding holes 57, thereby the spout base 14 can be securetly fastened to a container.

Figure 32:
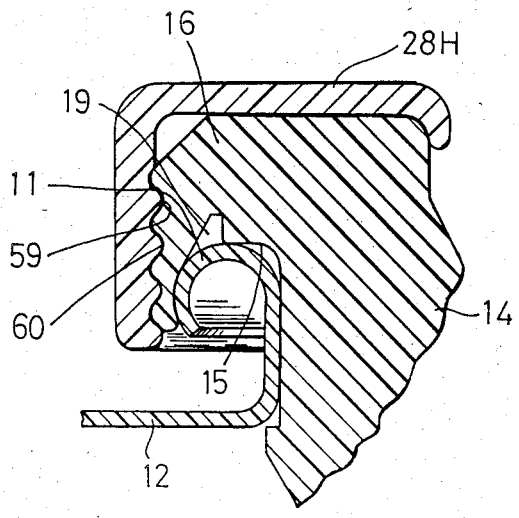

In the embodiment shown in FIG. 32, what differs from the aforesaid embodiment of the invention shown in FIG. 25 is that a female screw portion 59 is provided at an inner surface of the periphery wall of an annular plastic ring 28H and a male screw portion 60 is provided at an outer periphery portion of the ring fitting portion 16 of the spout base 14. The male screw portion 60 is meshed with the female screw portion 59 by screwing, and thereby it is possible to fix the spout base 14 to the spout assembly fitting portion 11 formed at the top plate 12 by screwing an annular plastic ring 28H.

As will be apparent from the aforesaid explanations, the invention has many effects as listed below.

(1) As the outer diameter of the cap mounted removably on the spout is made smaller than the internal diameter of the annular crimping ring for fixing the spout base to the spout assembly fitting portion, it is possible to fix the spout assembly to the spout assembly fitting portion of the container by using the annular ring after the spout base has been integrally assembled with a cap. Accordingly it is possible to fit the spout assembly heretofore in use which can fit the spout base to the spout assembly fitting portion of the container after taking apart into the spout base and the cap.

(2) Owing to the above item (1), it is possible to integrally assemble the spout base and the cap before shipping and therefore it is possible to pack the spout assembly easily.

(3) Owing to the above items (2), it has no difficulty in ascertaining the numbers of parts at the time of delivery. Having described the invention as related to the embodiments of the spout and the cap fitted by screw, it is our intention that the invention be not limited by any of the details of the description, but rather be constructed by appended claims.

What is claimed is:

1. A spout assembly adapted to be fastened to a spout assembly fitting portion of a container for pouring a material in the container through the spout assembly, comprising:

a spout section adapted to be fastened to the container, said spout section including a ring fitting portion to be placed above the spout assembly fitting portion and having a circular upper surface, a lower surface, an outer portion extending downwardly and radially outwardly from the circular upper surface, diameter of the outer portion increasing as the outer portion extends downwardly to thereby form a tapered outer surface, and an inner portion adjacent the outer portion, an overhang extending downwardly and radially outwardly from the outer portion of the ring fitting portion, diameter of the overhang increasing as the overhang extends downwardly, a concave groove formed in the ring fitting portion inside the overhang, said concave groove extending upwardly from the lower surface of the ring fitting portion to provide and maintain flexibility of the overhang, a spout base extending downwardly from the lower surface of the inner portion of the ring fitting portion beyond the overhang so that the spout assembly fitting portion is securely retained between the overhang and the spout base, said spout base having a plurality of pieces extending outwardly from the spout base to prevent the spout base from being removed from the spout assembly fitting portion, a tubular portion integrally connected to the upper portion of the spout base and having an outer end and first engaging means adjacent to the outer end, said tubular portion being flexible so that the tubular portion extending outwardly from the spout base can be folded to be substantially situated under the ring fitting portion, and a sealing diaphragm integrally formed with the tubular portion adjacent to the outer end of the tubular portion, an annular ring to be placed over the ring fitting portion and the overhang of the spout section so that the spout section can be securely connected to the spout assembly fitting portion of the container, and a cap member including a top wall portion adapted to be placed above the outer end of the tubular portion, a cylindrical portion integrally connected to the top wall portion and extending downwardly therefrom, said cylindrical portion having a second engaging means engaging the first engaging means when the cap member is fastened to the tubular portion, and a handle portion integrally formed with the cap member, said handle portion being disposed around the top wall portion when not used and being oriented upwardly from the top wall portion when used, the diameter of the handle portion, when the handle portion is not used, being smaller than the inner diameter of the ring fitting portion of the spout section and being substantially located inside the ring fitting portion so that one of the containers fitted with one of the spout assemblies can be stacked on another of the containers likewise fitted with one of the spout assemblies without interference by the handle portion of the spout assembly of the lower of the stacked containers, the diameter of the top wall portion being larger than the diameter of the tubular portion of the spout section so that when the tubular portion is folded, the top wall portion seals around the tubular portion.

2. A spout assembly according to claim 1, in which said tubular portion includes first and second tubular portions, and first and second bending portions, the first bending portion being situated between the first tubular portion and the spout base, and the second bending portion being situated between the first tubular portion and the second tubular portion so that when the tubular portion is folded, the first and second bending portions bend to thereby allow the tubular portion to be held below the ring fitting portion.

3. A spout assembly according to claim 2, in which said top wall portion of the cap member includes an annular groove under the top wall portion, said annular groove receiving the outer end of the tubular portion so that the tubular portion can be completely sealed by the cap member.

4. A spout assembly according to claim 3, in which said top wall portion of the cap member further includes an annular rim under the top wall portion around the outer periphery thereof so that the cap member can be securely sealed over the spout section.

5. A spout assembly according to claim 4, further comprising protection means situated between the top wall portion and the sealing diaphragm, said protection means being connected to either the top wall portion or the sealing diaphragm so that the sealing diaphragm can be protected from damage.

6. A spout assembly according to claim 3, in which said cap member further includes third engaging means under the periphery of the cap member, and said spout section further includes fourth engaging means inside the spout base, said third and fourth engaging means engaging with each other when the first and second engaging means engage together.

* * * * *